US005213959A

United States Patent [19]

Saitou et al.

[11] Patent Number: 5,213,959

[45] Date of Patent: May 25, 1993

[54] SILVER HALIDE PHOTOGRAPHIC MATERIAL

[75] Inventors: Mitsuo Saitou; Hisashi Okamura; Tadashi Ikeda, all of Kanagawa, Japan

[73] Assignee: Fuji Photo Film Co., Ltd., Kanagawa, Japan

[21] Appl. No.: 718,180

[22] Filed: Jun. 20, 1991

[30] Foreign Application Priority Data

Jun. 20, 1990 [JP] Japan ..... 2-161924
May 23, 1991 [JP] Japan ..... 3-146503

[51] Int. Cl.[5] ..... G03C 1/06

[52] U.S. Cl. ..... 430/607; 430/627; 430/629; 430/642

[58] Field of Search ..... 430/607, 609, 627, 629, 430/642

[56] References Cited

U.S. PATENT DOCUMENTS 4,879,193 11/1989 Takaya ..... 430/229

*Primary Examiner*—Jack P. Brammer
*Attorney, Agent, or Firm*—Sughrue, Mion, Zinn, Macpeak & Seas

[57] ABSTRACT

A silver halide light-sensitive material containing at least silver halide grains, a dispersion medium, an antifoggant, and a hardening agent, wherein said antifoggant is an antifoggant having a reactive substituent capable of reacting with a functional group of the dispersion medium to form a covalent bond after adsorption on the silver halide grains and/or an antifoggant previously covalently bonded to the dispersion medium. The antifoggant is immobilized in a light-sensitive material while exerting its antifogging activity and is not therefore dissolved into a developing solution.

2 Claims, No Drawings

SILVER HALIDE PHOTOGRAPHIC MATERIAL

FIELD OF THE INVENTION

This invention relates to a silver halide photographic material, and more particularly to a silver halide light-sensitive material containing at least silver halide grains, a dispersion medium, a pendant type antifoggant, and a hardening agent.

BACKGROUND OF THE INVENTION

Most of silver halide light-sensitive materials essentially contain an antifoggant as an additive called an emulsion stabilizer for prevention of fogging during preservation or called development restrainer for prevention of fogging during development. However, an antifoggant has the following disadvantage.

When a light-sensitive material is development processed, the antifoggant is dissolved from the material and accumulated in a developing solution. As the amount of the accumulated antifoggant increases, developing properties of the light-sensitive material are adversely affected, resulting in deterioration of reproducibility of developing properties and reduction in developing capacity of the developing solution. As the developing capacity is reduced, the amount of the developing solution waste liquor increases, leading to an increased cost. It has therefore been demanded to develop a silver halide light-sensitive material free from such a problem.

A polymerized compound obtained by polymerizing an antifoggant linked with a repeating unit of a synthetic high polymer has been proposed as an antifoggant having improved non-diffusibility as disclosed in U.S. Pat. Nos. 3,576,638, 3,598,599, 3,598,600, and 3,936,401, JP-A-57-211142, and JP-A-62-949 (the term "JP-A" as used herein means an "unexamined published Japanese patent application"). In any of these polymerized antifoggants, however, the antifoggant moiety is not bound to a gelatin dispersion medium so that there still remains a problem that the antifoggant is not completely immobilized. If an antifoggant is completely immobilized, it follows that the antifoggant could not reach the surface of silver halide grains, failing to be adsorbed thereon and, accordingly, the action as an antifoggant would be lessened.

SUMMARY OF THE INVENTION

An object of the present invention is to provide a silver halide light-sensitive material containing an antifoggant, in which said antifoggant is surely immobilized so as to be surely prevented from being dissolved in a developing solution during development processing while performing an effective antifogging function.

The object of the present invention is accomplished by:

1) A silver halide light-sensitive material containing at least silver halide grains, a dispersion medium, a pendant-1 type antifoggant, and a hardening agent, wherein said pendant-1 type antifoggant is an antifoggant having a reactive substituent capable of reacting with a functional group of the dispersion medium and at least 20% of said antifoggant forms a covalent bond with the dispersion medium at the time of delivery.

2) A silver halide light-sensitive material containing at least silver halide grains, a dispersion medium, a pendant-2 type antifoggant, and a hardening agent, wherein said pendant-2 type antifoggant is an antifoggant covalently bonded to a low-molecular weight dispersion medium.

3) A silver halide light sensitive material containing at least silver halide grains, a dispersion medium, a pendant-3 type antifoggant, and a hardening agent, wherein said pendant-3 type antifoggant is an antifoggant covalently bonded to the dispersion medium in a weight ratio of at least 3%.

DETAILED DESCRIPTION OF THE INVENTION

In the present invention, elution of an antifoggant from a silver halide emulsion layer into a developing solution at the time of development processing can be prevented by a first embodiment in which a reactive substituent capable of reacting with a functional group of a dispersion medium is introduced into an antifoggant or a second embodiment in which an antifoggant previously bound to a dispersion medium through a covalent bond is used.

According to the first embodiment, when such a reactive antifoggant is added to a silver halide emulsion, the antifoggant moiety is adsorbed onto the surface of silver halide grains. Then, the reactive substituent undergoes chemical reaction with a functional group of a dispersion medium to form a covalent bond with the dispersion medium to thereby immobilize the antifoggant by the dispersion medium almost completely by the time the light-sensitive material is subjected to development. The antifoggant is thus prevented from being eluted in a developing solution during development. In other words, since the reactive antifoggant is not immobilized or rendered non-diffusible when added to a silver halide emulsion, it migrates to silver halide grains and is adsorbed thereon. After an adsorption equilibrium is reached, the antifoggant is covalently bonded to a dispersion medium and thereby immobilized. Accordingly, immobilization of an antifoggant can be achieved while assuring adsorption onto silver halide grains.

According to the second embodiment, after the antifoggant covalently bonded to a dispersion medium is added to a silver halide emulsion and an adsorption equilibrium is reached, the dispersion medium moiety of the antifoggant is chemically bonded to a dispersion medium by a hardening agent and thereby immobilized. In this embodiment, hindrance to antifoggant's migration to silver halide grains can be alleviated by reducing the molecular weight of the dispersion medium moiety of the antifoggant. Further, the proportion of the bond between the antifoggant moiety and the dispersion medium moiety (hereinafter referred to as bonding ratio) is preferably adjusted to 3% by weight or more thereby to increase adsorptivity, to accelerate adsorption onto the silver halide grain surface, and to prevent diffusion of the antifoggant. In addition, by such adjustment, a requisite number of molecules of the antifoggant on the silver halide grain surface can be assured.

The terminology "pendant-1 type antifoggant" as used herein means an antifoggant in which a reactive substituent is organochemically bonded to an antifoggant moiety via a linking group. The terminology "pendant-2 type antifoggant" as used herein means an antifoggant in which an antifoggant moiety and a low-molecular dispersion medium (e.g., gelatin) moiety are organochemically bonded via a linking group. The terminology "pendant-3 type antifoggant" as used herein means an antifoggant in which an antifoggant moiety and a dispersion medium (e.g., gelatin) moiety are organochemically bonded either directly or via a linking group, with the bonding ratio of the antifoggant being 3% by weight or more.

The pendant-1, pendant-2 and pendant-3 type antifoggants are preferably represented by formulae (I-1), (I-2) and (I-3), respectively:

$$\text{Antifoggant}\leftarrow\text{L-Reactive Substituent})_x \quad \text{(I-1)}$$

$$(\text{Antifoggant-L})_m(\text{Low-Molecular Gelatin}) \quad \text{(I-2)}$$

$$(\text{Antifoggant-L})_p\text{Gelatin} \quad \text{(I-3)}$$

wherein L represents a divalent linking group; x represents an integer of from 1 to 3; and m and p each represent a number of antifoggant molecules bonded per molecule of gelatin.

The antifoggant (or antifoggant moiety) as referred to in the present invention includes conventionally known antifoggants, such as nitrogen-containing heterocyclic compounds containing a saturated or unsaturated and substituted or unsubstituted 5- to 7-membered heterocyclic ring containing at least one nitrogen atom. The heterocyclic ring may be a condensed ring and may further contain hetero atoms other than a nitrogen atom. Preferred antifoggants are those represented by formula (II-1):

$$Z—Y \quad \text{(II-1)}$$

wherein Z represents an azole ring (e.g., imidazole, triazole, tetrazole, thiazole, oxazole, selenazole, benzimidazole, benzindazole, benzotriazole, benzoxazole, benzothiazole, thiadiazole, oxadiazole, benzoselenazole, pyrazole, naphthothiazole, naphthoimidazole, naphthoxazole, azabenzimidazole, purine), a pyrimidine ring, a triazine, ring, a pyridine ring, or an azaindene ring (e.g., triazaindene, tetraazaindene, pentaazaindene), preferably an azole ring or an azaindene ring, and more preferably a tetraazaindene ring or a mercaptotetrazole ring, provided that a triazine, diazine or pyridine ring containing a halogen atom is excluded; and Y represents a hydrogen atom or a substituent, e.g., a substituted or unsubstituted alkyl group (e.g., methyl, ethyl, hydroxyethyl, trifluoromethyl, sulfopropyl, dipropylaminoethyl, adamantane, benzyl, p-chlorophenethyl), a substituted or unsubstituted alkenyl group (e.g. allyl), a substituted or unsubstituted aryl group (e.g., phenyl, naphthyl, p-carboxyphenyl, 3,5-dicarboxyphenyl, m-sulfophenyl, p-acetamidophenyl, 3-caprylamidophenyl, p-sulfamoylphenyl, m-hydroxyphenyl, p-nitrophenyl, 3,5-dichlorophenyl, 2-methoxyphenyl), a heterocyclic group (e.g., pyridine ring), a halogen atom (e.g., chlorine, bromine), a mercapto group, a cyano group, a carboxyl group, a sulfo group, a hydroxyl group, a nitro group, an alkoxy group (e.g., methoxy, ethoxy), an aryloxy group (e.g., phenoxy), an acyl group (e.g., acetyl), an acylamino group (e.g., acetylamino, caproylamino, methylsulfonyl amino), a substituted amino group (e.g., diethylamino, hydroxyamino), an alkyl- or arylthio group (e.g., methylthio, carboxyethylthio, sulfobutylthio), an alkoxycarbonyl group (e.g., methoxycarbonyl), and an aryloxycarbonyl group (e.g., phenoxycarbonyl).

The nitrogen-containing heterocyclic compounds further include disulfide compounds represented by formula (II-2):

$$Z—S—S—Z \quad \text{(II-2)}$$

wherein Z is as defined above.

Of these disulfide compounds, preferred are azaindenes, azoles, and azoles containing a mercapto group, and more preferred are tetraazaindenes and mercaptotetrazoles.

The compounds of formula (II-1) are preferred to those of formula (II-2).

Specific examples of the tetraazaindenes include those represented by formulae (III-1), (III-2), (III-3) and (III-4):

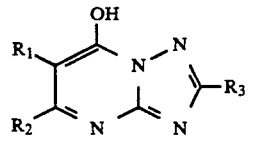
(III-1)

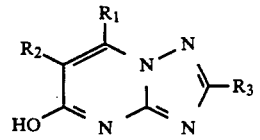
(III-2)

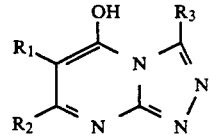
(III-3)

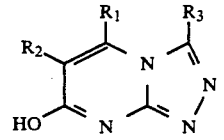
(III-4)

wherein $R_1$, $R_2$, and $R_3$ each represent a hydrogen atom, a halogen atom, an amino group, an alkyl group, or an aryl group.

A linking group L can be introduced into any of $R_1$, $R_2$, and $R_3$.

In addition, compounds composed of the above-described antifoggants organochemically bonded to each other via a divalent linking group either symmetrically or asymmetrically. The divalent linking group to be used here has not more than 20 carbon atoms, such as an alkylene group, an arylene group, an alkenylene group, $—SO_2—$, —SO—, —O—, —S—, —CO—, —NR— (wherein R represents an alkyl group, an aryl group, or a hydrogen atom), a heterocyclic divalent group (e.g.,

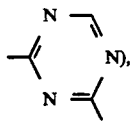

and a combination of two or more thereof. For example, tetraazaindene compounds of this type are described in JP-A-61-14630.

Specific examples of these known antifoggants are described in *Research Disclosure*, Vol. 176, Item 17643 (Dec., 1978), ibid., Vol. 184, Item 18431 (Aug., 1979), ibid., Vol. 217, Item 21728 (May, 1982), E. J. Birr, *Stabi-*

*lization of Photographic Silver Halide Emulsions,* Focal Press, London (1974), T. H. James (ed.), *The Theory of Photographic Process,* 4th Ed., Chs. 1, 11 and 13, Macmillan, New York (1977), P. Glafkides, *Chimie et Physique Photographiques,* 5th Ed., Part 3, Edition de l'Usine Nourelle, Paris (1987), and Chemical Society of Japan (ed ), *Shin Jikken Kagaku Koza* 14, "Yuki Kagobutsu no Gosei to Han-no IV", Maruzen, Tokyo (1978).

Antifoggants to which a sensitizing dye is covalently bonded are also useful. Reference here can be made to U.S. Pat. No. 4,987,064. In this type of antifoggants, antifoggant moieties corresponding to the formulae (II-1) and (II-2) in which Z is a triazine ring, a diazine ring, or a pyridine ring are excluded. Note that these antifoggants are not so preferred as the compounds of formula (II-1) or (II-2) because of involvement of a longer route for synthesis as compared with the latter.

The divalent linking group as represented by L in the pendant type antifoggants represented by formulae (I-1 to 3) contains not more than 30 carbon atoms and includes an alkylene group, an arylene group, an alkenylene group, —$SO_2$—, —SO—, —O—, —S—, —CO—, —NR— (wherein R represents an alkyl group, an aryl group, or a hydrogen atom), a heterocyclic divalent group, and a combination of two or more thereof.

The reactive substituent which can be introduced into an antifoggant according to the first embodiment of the present invention is a substituent capable of reacting a functional group of a dispersion medium to form a covalent bond. Such a reactive substituent includes reactive groups possessed by a gelatin hardening agent, reactive groups capable of forming gelatin derivatives hereinafter described, and reactive groups proposed by Steiger, et al. in JP A-51-117619. For details of these reactive groups, refer to T. H. James (ed.), *The Theory of Photographic Process,* 4th Ed., Ch. 2, Par. III, A. G. Ward and A. Courts, *The Science and Technology of Gelatin,* Ch. 7, Academic Press, New York (1977), and descriptions hereinafter given.

In more detail, examples of the reactive substituent of the pendant-1 type antifoggant include an aldehyde group, a protected aldehyde group, an acid anhydride group, an acid halide group, a diketone group, an active ester group, an active halide group, an active olefinic group, an isocyanate group, an isothiocyanate group, an epoxy group, an aziridine group, a dioxolane group, an alkanesultone group, a carboxylazido group, an N-carbamoyl group, an isoxazolium salt group, an aromatic amino acid group, and a carboxyl group activated by a carbodiimide reagent. Preferred of them are an aldehyde group, an acid anhydride group, an acid halide group, a diketone group, an active halide group, an active olefinic group, an epoxy group, an aziridine group, an alkanesultone group, a carboxylazido group, and a carboxyl group activated by a carbodiimide reagent. More preferred are an acid halide group, an acid anhydride group, an epoxy group, a carboxyl group activated with a carbodiimide reagent, an aziridine group, and a carboxylazido group.

The reactive substituent is preferably composed of two or more reactive groups like a hardening agent because even if one of the reactive groups undergoes an ineffective reaction, the other reactive group(s) undergo an effective reaction to accomplish the object of the present invention.

Specific examples of the above-described reactive substituents inclusive of a linking group L are shown below. In the following formulae, $L_1$ represents a part of a linking group; * indicates the position for bonding to an antifoggant moiety; $R_1$, $R_2$, and $R_3$ are as defined above with respect to formulae (III-1 to 4); and X represents a halogen atom selected from F, Cl, Br, and I according to the purpose.

1) Aldehyde group:

*—L—CHO, *—$L_1$—$CH_2$—CH=CHO,

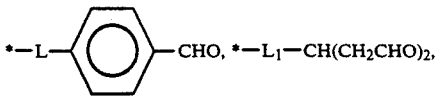

*—$L_1$—$CH_2$CHO

2) Protected aldehyde group:

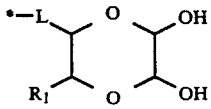

3) Diketone group:

*—L—CO—$COCH_3$, *—L—

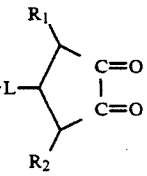

4) Acid anhydride group:

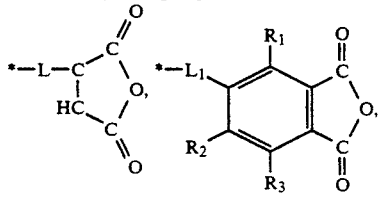

*—$L_1$$CH_2$CO—S

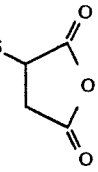

5) Acid halide group:

*—L—$SO_2$X, *—L—COX, *—$L_1$—O—COX

6) Active ester group:

*—$L_1$—O—C(=O)—$CH_2$X, *—L—O—$SO_2CH_3$,

*—L—O—$SO_2CH_2$X

7) Active halide group:

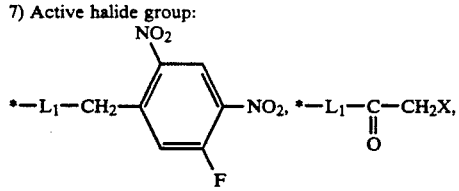

*—$L_1$—C(=O)—$CHX_2$, *—$L_1$—O—C(=O)—$CH_2$X,

*—$L_1$—CHCl—$CH_2$—NH—C(=O)—$NH_2$,

-continued $*-L-SO_2-CH_2-CH_2Cl$, $*-L_1-CHCl-CH=CHCONH_2$,

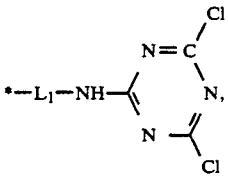

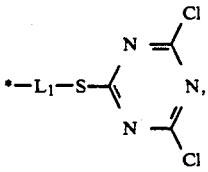

group having a haloamidinium sturcture

8) Active olefinic group:

$*-L-SO_2-CH=CH_2$, $*-L-O-SO_2-CH=CH_2$,

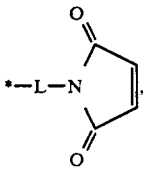

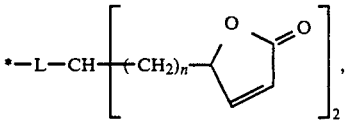

(n: 1 to 12)

$*-L_1-CO-CH=CHX$

Preferred of these active olefinic groups are the first two groups.

9) Isocyanate group:

$*-L-N=C=O$

10) Isothiocyanate group:

$*-L-NCS$

11) Epoxy group:

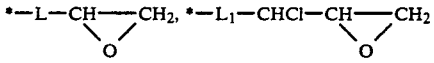

12) Aziridine group:

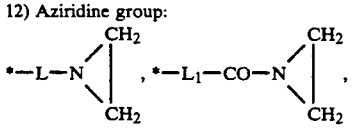

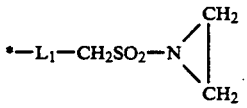

13) Dioxolane group:

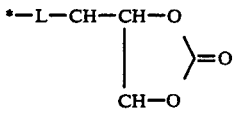

14) Alkanesultone group:

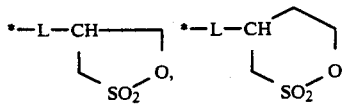

15) Isoxazolium base:

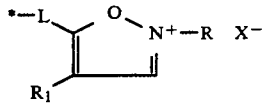

(wherein R is an alkyl group having from 1 to 4 carbon atoms with or without sulfonate; and $X^-$ is a soluble anion)

16) Carboxylazido group:

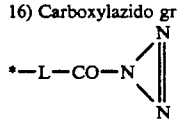

17) Aromatic amino acid group:

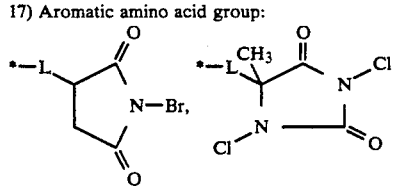

18) Utilization of carbodiimide:

$*-L-CCOOH + R_1-N=C=N-R_2 \longrightarrow$ $*-L-CO-NR_1-CO-NH-R_2$ ($R_1$, $R_2$: alkyl or aryl group)

A carboxyl group of an antifoggant is activated by reaction with a carbodiimide reagent to form a reactive group which easily reacts with an amino group of gelatin.

Examples of the carbodiimide reagents are N,N'-dicyclohexylcarbodiimide, 1-ethyl-3-(3-dimethylaminopropyl)carbodiimide, and 1-benzyl-3-(3-dimethylaminopropyl)carbodiimide.

A carboxyl group of an antifoggant can also be activated by using a condensation reagent, e.g., N-ethyl-5-phenylisoxazolium-3'-sulfonate, or an active ester, e.g., pentachlorophenyl chloroacetate, p-nitrophenyl trifluoroacetate, and p-nitrophenyl chloroacetate.

Also included in reactive substituents are $NH_2$, —COOH, and —OH. The reactive substituent of this type is reacted with a hardening agent after coating of an emulsion whereby the hardening agent crosslinks the antifoggant and gelatin molecules. While the effects of the present invention are obtained by these reactive substituents, the embodiment of using the above-mentioned group of reactive substituents is preferred.

Of the above-described reactive substituents, particularly preferred are those obtained by activating a carboxyl group with a carbodiimide reagent. In using these carbodiimide-activated groups, it is preferable that a carboxyl group of gelatin dispersion medium is also activated with a carbodiimide reagent. In this case, it is further preferable that the concentration of carbodiimide-activated carboxyl groups of gelatin to that of carboxyl groups of the antifoggant on the silver halide grains is from 10 to 1/10, preferably from 3 to ⅓, and more preferably from 2 to ½. The hardening agent here is a known photographic hardening agent as hereinafter described in detail.

Synthesis examples of the pendant-1 type antifoggant are illustrated below.

SYNTHESIS EXAMPLE 1

Synthesis of Compound A

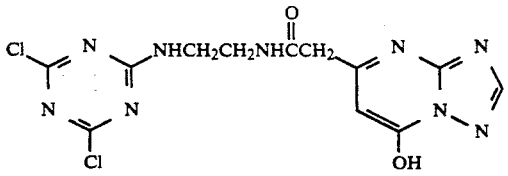

To a mixture of 2.4 g of 4-hydroxy-6-[N-(2-aminoethyl)carbamoylmethyl]-1,3,3a,7-tetraazaindene (synthesized by treating the corresponding carboxylic acid with dicyclohexylcarbodiimide in the presence of excess ethylenediamine), 1.0 g of N-methylmorpholine, and 80 ml of acetonitrile was added dropwise a solution of 1.8 g of 2,4,6-trichloro-1,3,5-triazine in 20 ml of tetrahydrofuran over 20 minutes under cooling with ice. After stirring for 3 hours under ice-cooling, the volatile content was removed by distillation at 30° C. The residue was purified by silica gel chromatography to obtain 2.2 g of the titled compound. The chemical structure of the product was confirmed by the NMR spectrum and IR spectrum.

SYNTHESIS EXAMPLE 2

Synthesis of Compound B

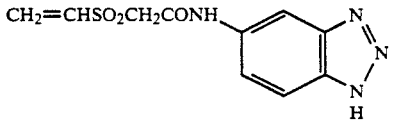

To a mixture of 1.3 g of 5-aminobenzotriazole, 2.0 g of triethylamine, and 50 ml of acetonitrile was added in small portions 2.0 g of 2-chloroethylsulfonylacetyl chloride (synthesized by hydrolyzing the corresponding amide with hydrochloric acid and reacting the product with thionyl chloride) under ice-cooling. After stirring under ice-cooling for 30 minutes and then at room temperature for 1 hour, the volatile content was removed by distillation under reduced pressure. The residue was purified by silica gel chromatography to obtain 1.5 g of the titled compound. The chemical structure was confirmed by the NMR spectrum and IR spectrum.

SYNTHESIS EXAMPLE 3

Synthesis of Compound C

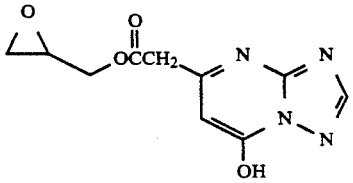

To a mixture of 1.9 g of 6-carboxymethyl-4-hydroxy-1,3,3a,7-tetraazaindene, 100 mg of 4-(N,N-dimethylamino)pyridine, 5 g of glycidol, and 100 ml of acetonitrile was added dropwise a solution of 2.1 g of N,N'-dicyclohexylcarbodiimide in 20 ml of acetonitrile at room temperature over 30 minutes, followed by stirring at room temperature for 3 hours. The volatile content was removed by distillation under reduced pressure, and the residue was purified by silica gel chromatography to obtain 1.2 g of the titled compound. The chemical structure was confirmed by the NMR spectrum and IR spectrum.

Specific examples of the pendant-1 type antifoggants are shown below.

(IV-1)

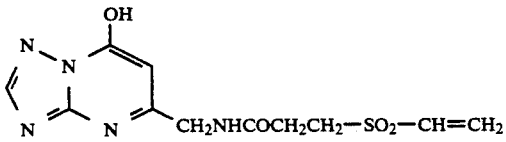

(IV-2)

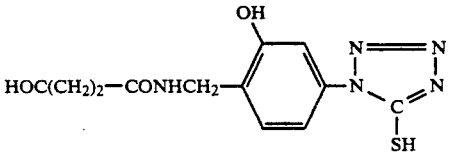

(IV-3)

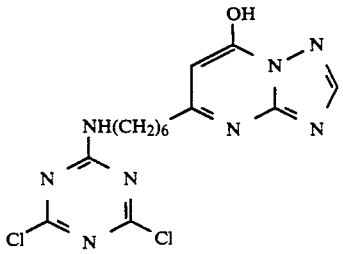

(IV-4)

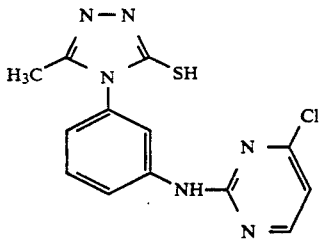

(IV-5)

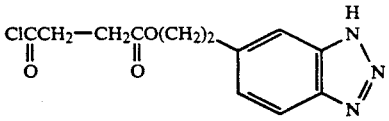

(IV-6)

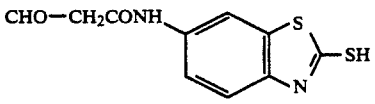

(IV-7)

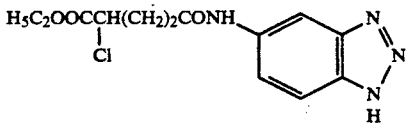

(IV-8)

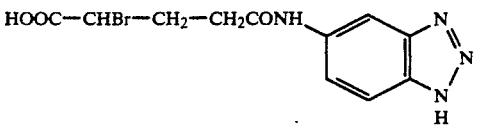

-continued

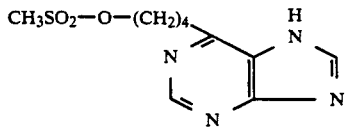

(IV-9)

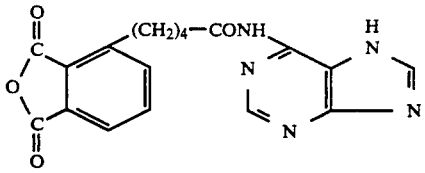

(IV-10)

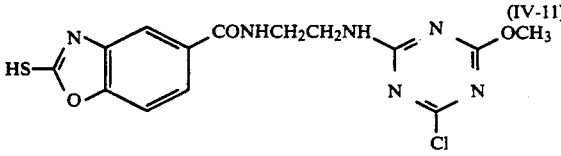

(IV-11)

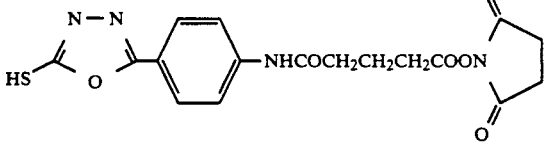

(IV-12)

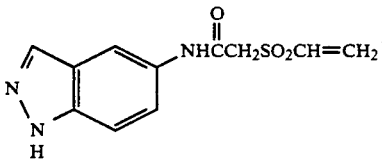

(IV-13)

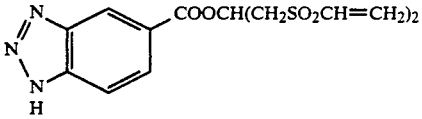

(IV-14)

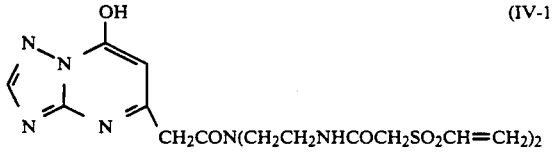

(IV-15)

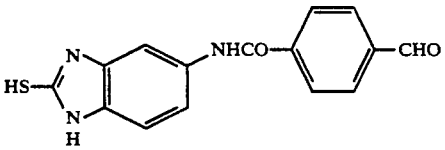

(IV-16)

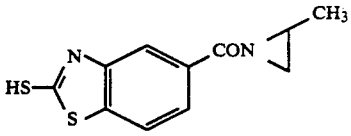

(IV-17)

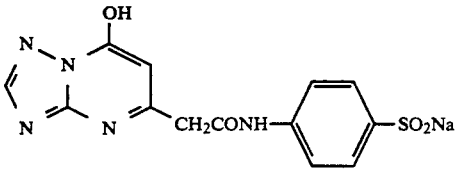

(IV-18)

-continued

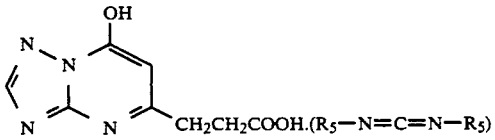

(IV-19)

$R_5$ = cyclohexyl

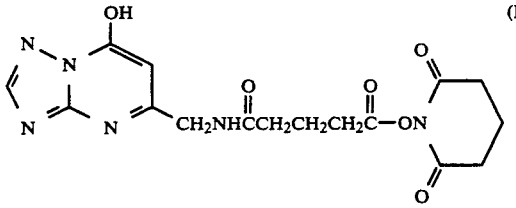

(IV-20)

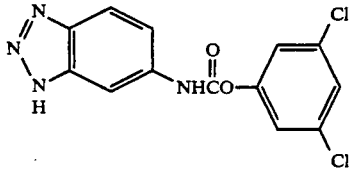

(IV-21)

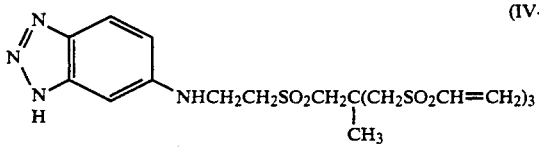

(IV-22)

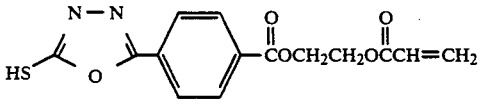

(IV-23)

A reactive substituent in the pendant-1 type antifoggants is selected according to ease of synthesis and reactivity with a dispersion medium, taking care that the selected reactive group or the reaction product thereof does not adversely affect silver halide grains. For example, addition reaction to an active olefinic group is a favorable choice for its producing no by-product.

After the pendant-1 type antifoggant having a reactive substituent is added to a silver halide emulsion and adsorbed on the surface of silver halide grains, the reactive substituent is chemically reacted with a functional group of a dispersion medium to form a covalent bond. It is preferable that the chemical reaction completes by the time of product delivery from the factory. That is, it is desirable that at least 20%, preferably 60%, and more preferably 80% or more, by weight of the bonding reaction by covalent bond be completed by the time of delivery. Similarly to hardening reaction of conventional hardening agents, the above-described bonding reaction predominantly proceeds at the time of coating, drying, and the subsequent heat treatment. The reaction is accelerated by an increase in gelatin concentration (i.e., an increase in functional group concentration) on drying and by the heat treatment after drying. With respect to the bonding reaction conditions, conditions of hardening with conventional hardening agents can be referred to. In general, a silver halide emulsion, after being coated, is allowed to gel at a temperature of from 0° to 30° C. and dried at a temperature of from 15° to 40° C. and at a relative humidity of from 30 to 80%. Then, the emulsion is usually heated at a temperature of from 35° to 55° C. and at a relative humidity of from 80 to 100%, or the coated film is rolled, sealed, and heated at 35° to 55° C. for 1 to 100 hours, to accelerate the hardening reaction. These hardening conditions also apply to acceleration of the bonding reaction of the present invention. In practice, experiments are conducted under varied conditions of temperature, humidity and time, and the degree of elution of the antifoggant in a developing solution upon development is examined to decide the optimum conditions.

The percent of bonding reaction (y%) can be determined as follows. A plurality of samples having a varied y% of an antifoggant added immobilized in a dispersion medium are prepared by adding (100−y)% of the antifoggant to a silver halide emulsion and coating and drying the emulsion. An elution test is conducted on each of the samples under equal conditions to prepare a graph of the eluted antifoggant concentration vs. y%. Then the same elution test is conducted on a sample under analysis (coating and drying conditions being equal to those of the comparative samples) to obtain the eluted antifoggant concentration, and the value y is obtained from the above-prepared graph.

The length of the linking group L linking the antifoggant and the reactive substituent is preferably from 0 to 100 Å, more preferably from 1 to 50 Å, and most preferably from 4 to 50 Å. With a short length of L, the reactive substituent is reacted only with the gelatin functional group near the surface of silver halide grains. With a long length of L, the reactive substituent is capable of reacting with the farther gelatin functional groups. However, it is likely that too a long linking group causes desorption from the silver halide grains. Accordingly, it is preferable that the linking group is as short as possible as far as the number of the functional groups corresponding to the number of antifoggant molecules adsorbed on the silver halide grains may be assured. It is also preferable to use a combination of two or more antifoggants differing in length of the linking group thereof for the reason that functional groups of gelatin at various positions away from the silver halide grains may be reacted. It is further preferable to use the above-described antifoggants linked via a linking group for the reason that the required number of the functional group can be assured with more ease, that is, the number of the reactive substituents per the number of molecules of the antifoggant is reduced.

Dispersion media which can be used in the present invention are conventional and preferably include gelatin dispersion media. The gelatin dispersion media include gelatin and gelatin derivatives. Specific examples of the gelatin dispersion media are alkali-processed gelatin, acid-processed gelatin, gelatin derivatives such as phthalated gelatin, low-molecular weight gelatin (molecular weight: 2,000 to 100,000) obtained by enzymatic decomposition, acid- or alkali-hydrolysis, or thermal decomposition), gelatin having a methionine content of not more than 50 μmol/g, oxidized gelatin, and mixtures of two or more of these gelatin species. Gelatin derivatives include reaction products between gelatin and an acid halide, an acid anhydride, an isocyanate, bromoacetic acid, an alkanesultone, a vinylsulfonamide, a maleinimide compound, a polyalkylene oxide, an epoxy compound, etc.

In the first embodiment of the present invention in which a reactive substituent bonded to an antifoggant is reacted with a functional group of a dispersion medium to form a covalent bond, the bonding reaction rapidly proceeds in the presence of a sufficient number of the functional groups of the dispersion medium. Accordingly, use of such a gelatin derivative whose functional group is blocked is unfavorable. In the case of using —COOH as a functional group, alkali-processed gelatin in which glutamine or asparagine is converted to glutamic acid or aspartic acid is preferred. In this case, it is preferable that at least 30%, more preferably at least 60%, and most preferably at least 90%, of the $—CONH_2$ group of glutamine or asparagine is converted to —COOH. In the case of using $—NH_2$ as a functional group, gelatin in which arginine is converted to ornithine is preferrred. In this case, it is preferable that at least 20%, more preferably at least 40%, and most preferably at least 80%, of arginine is converted to ornithine. In these cases, gelatin preferably have a molecular weight as employed in the conventional photographic gelatin, i.e., an average molecular weight of from $8\times10^4$ to $1.5\times10^5$. For details of these gelatin species, the literatures hereinafter listed can be referred to.

The pendant-1 type antifoggant represented by formula (I-1) has a reactive substituent capable of reacting a functional group of a dispersion medium. The functional group of a dispersion medium as herein referred to includes an amino group, a carboxyl group, and a hydroxyl group, and preferably an amino group, a carboxyl group, and a hydroxyl group of gelatin. Gelatin is a preferred dispersion medium because it has higher contents of these functional groups than any other dispersion media and undergoes the bonding reaction with the most ease.

In using —COOH as a functional group, a gelatin species whose carboxyl group is activated by the action of a carbodiimide reagent is preferably used. For details of such activation, JP-A-2-305876 can be referred to.

While a hardening reaction with a hardening agent may be performed simultaneously with the bonding reaction as conventionally done, the bonding reaction preferably takes precedence of the hardening reaction. To this effect, a hardening agent having a lower reaction rate than the bonding reaction rate is chosen, or reaction conditions for hardening are so selected. If the hardening reaction takes precedence of the bonding reaction, the reactive groups on both of the antifoggant and the dispersion medium are immobilized through the preceding hardening reaction to lessen the probability of their meeting together, and the bonding reaction tends to be retarded.

Such troublesome care can be precluded by employing the above-described second embodiment in which an antifoggant previously bonded to gelatin molecules is added to a silver halide emulsion and, after an adsorption equilibrium is reached, the gelatin moiety of the antifoggant is chemically bonded to a gelatin dispersion medium by a hardening agent and is thus immobilized. In other words, hardening of a gelatin dispersion medium and immobilization of an antifoggant can be accomplished through the same reaction.

The organochemical bonding between an antifoggant and a gelatin molecule can be effected in the same manner as in the first embodiment. That is, a reactive substituent is introduced into an antifoggant, and the thus introduced reactive substituent is bonded to a functional group of the gelatin molecule. Alternatively, the reactive substituent and the gelatin functional group are bonded through crosslinking by the reaction with a hardening agent. Since the bonding reaction in this embodiment takes place in the absence of silver halide emulsion grains, accelerating conditions, such as an elevated temperature, can be employed to improve a rate of bond formation. The reactive substituent and antifoggant which can be used in the second embodiment are the same as in the first embodiment. It should be noted that the molecular weight of gelatin is preferably selected according to the purpose. According as the gelatin molecular weight (i.e., the chain length of gelatin molecules) increases, it becomes more difficult for the antifoggant to migrate in a silver halide emulsion. As a result, the antifoggant has difficulty in being adsorbed on silver halide grains, not only needing a long time for achieving an adsorption equilibrium but showing tendency of desorption from silver halide grains. On the other hand, the number of sites crosslinkable with a hardening agent increases with an increase of molecular weight, and immobilization by the hardening agent takes place with more ease. Accordingly, the most suitable molecular weight of gelatin can be selected according to the kind of a light-sensitive material, taking a balance of merits and demerits into consideration.

The dispersion medium in the pendant-2 type antifoggant which can be used in the second embodiment is preferably a low-molecular gelatin usually having a molecular weight of from 100 to $6\times10^5$, preferably 300 to $4\times10^4$, more preferably from 300 to $2\times10^4$, and most preferably from 500 to $1\times10^4$.

In order to improve adsorptivity of an antifoggant bonded to gelatin on silver halide grains, the number of molecules of the antifoggant bonded per molecule of gelatin, i.e., m or p in formula (I-2 or 3) may be increased to increase the site of adsorption. For the details, reference can be made to U.S. Pat. No. 4,987,064.

The number of antifoggant molecules bonded per molecule of gelatin depends on the number of bonding functional groups on the gelatin molecule. A number of antifoggant molecules which can be bonded to a gelatin molecule having n functional groups is from 1 to n. As the number of antifoggant molecules bonded, adsorptivity on silver halide grains is improved. A higher number of antifoggant molecules bonded is preferred also from the fact that the requisite number of antifoggant molecules is greater than the number of adsorbed gelatin molecules on silver halide grains. Gelatin having a molecular weight of, e.g., 96,000 approximately contains 32 aspartic acid residues, 11 asparagine residues, 45 glutamic acid residues, 29 glutamine residues, 40 serine residues, 16 threonine residues, 112 hydroxyproline residues, 34 lysine residues, 52 arginine residues, and 3 hydroxylysine residues. The $—CONH_2$ group of glutamine or asparagine having low reactivity can be nearly 100% converted to a carboxyl group —COOH by alkali treatment. Therefore, it is preferable to use a gelatin species in which 30% or more, more preferably 60% or more, and most preferably 90% or more, of $—CONH_2$ is converted to —COOH to have increased reactivity, which leads to an increased number of the antifoggant molecules bonded per molecule of gelatin (i.e., n). Likewise, although the functional group of arginine has low reactivity, arginine can be converted to ornithine (the functional group is converted to $—(CH_2)_3NH_2$) by alkali treatment at pH 13 or higher or enzymatic decomposition with arginase. Therefore, it is preferable to use a gelatin species in which 20% or more, more preferably 40% or more, and most preferably 80% or more, of arginine is converted to ornithine to increase n. The thus modified gelatin species (molecular weight: about 96000) has about 374 effective functional groups per molecule at the highest. The optimum number of bonded antifoggant molecules/gelatin for a certain light-sensitive material can be determined by examining characteristics of experimental coated samples of an emulsion containing a compound having a varied number of bonded antifoggant molecules.

Since the number of antifoggant molecules bonded per molecule of gelatin varies depending on the molecular weight of gelatin, a preferred range of the number is expressed in terms of a bonding ratio (%) of the antifoggant. In the case of the above-mentioned low-molecular gelatin, such a bonding ratio is preferably 0.5% by weight or more, more preferably from 1.6 to 50% by weight, further preferably from 3 to 40% by weight, and most preferably from 5 to 35% by weight. In particular, at a bonding ratio of from 3 to 50% by weight, preferably from 3 to 40% by weight, and more preferably from 6 to 30% by weight, adsorptivity is so improved that gelatin having a molecular weight of from $6\times10^5$ to $10^6$ is also acceptable. Nevertheless, the above-described low-molecular gelatin is still preferred.

The functional groups to which antifoggant molecules are bonded are preferably different from those serving as sites crosslinkable upon hardening. For example, where $—NH_2$ functions as a crosslinkable site, the antifoggant is preferably bonded to —COOH or —OH. Further, the gelatin moiety of the resulting gelatin-antifoggant compound should retain at least 1, preferably 3 or more, and more preferably from 5 to 30, crosslinkable sites.

The pendant-2 or pendant-3 type antifoggant according to the second embodiment of the invention is added to a silver halide emulsion and, generally after an adsorption equilibrium is reached, is reacted with a hardening agent to form a crosslinked structure with a gelatin dispersion medium. An average number of the crosslinked sites per molecule is usually 0.3 or more, preferably 0.6 or more, more preferably from 1.2 to 10, and most preferably from 1.6 to 8.

For formation of amido linkage between an antifoggant and gelatin, bonding reactions making use of biological substances, such as enzymes, bacteria, and fungi, and a Merrifield's solid phase reaction can be utilized to advantage. With respect to these and the above-described bonding methods, reference can be made to the literatures hereinafter described.

Examples of typical and simple bonding reactions are illustrated below.

Bonding Reaction Example 1

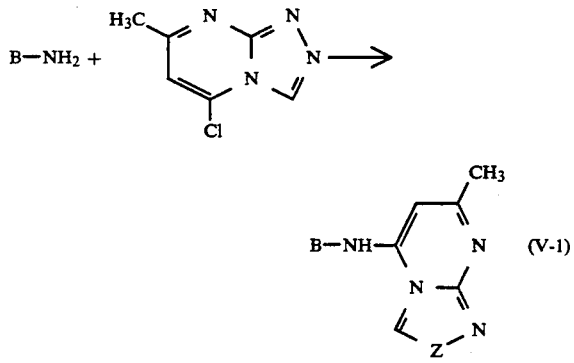

(V-1)

-continued

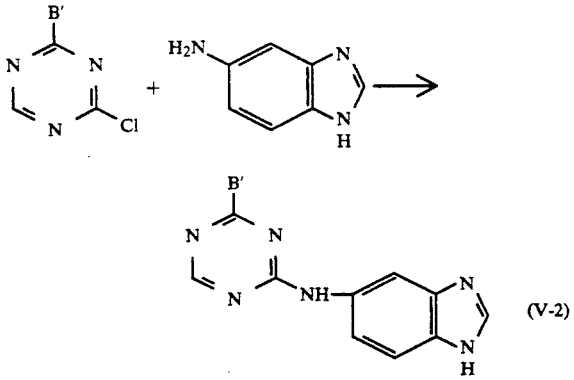

(V-2)

wherein B—$NH_2$ and B' each represent a gelatin dispersion medium molecule.

Bonding Reaction Example 2

In antifoggant compounds represented by formula:

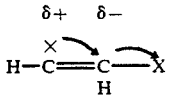

In cases where X is an electron attracting group, C becomes a cation and undergoes an addition reaction of an anionic reagent as illustrated below.

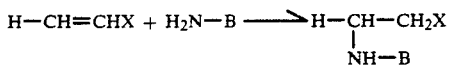

(V-3)

In the order of reactivity, the electron attracting groups X are $COR \geqq OSO_2R > SO_2R > SO_2NR_2 > CONR_2$, wherein R represents (antifoggant-linking group).

On the other hand, in cases where X acts as an electron-donor, the above-described addition reaction of an anionic reagent is exerted in the opposite direction. For example, where X is Cl, a great resonance effect is produced.

Reference can be made to A. Streitwieser, *Organic Chemistry*, Macmillan, New York (1985), L. G. Wade, *Organic Chemistry*, Prentice-Hall, Englewood, U.S.A. (1987), Izumiya Nobuo, et al., *Peptide Gosei no Kiso to Jikken*, Maruzen (1985), Chemical Society of Japan (ed.), *Shin Jikken Kagaku Koza* 14, [I]-[V], Maruzen (1977), JP-A-51-117619, and L. F. Fieser and M. Fieser, *Advanced Organic Chemistry*, Maruzen, Tokyo (1962).

An effective amount of the antifoggant to be added to a silver halide emulsion ranges from $3\times10^{-2}$ to $3\times10^{-5}$ mol, and preferably from $1\times10^{-2}$ to $1\times10^{-4}$ mol, per mol of silver halide. The terminology "effective amount" as used herein means the mole number of the antifoggant moiety. For example, when 1 mol of a compound in which 3 molecules of an antifoggant are bonded to 1 molecule of gelatin, the effective amount is 3 mols.

In the second embodiment of the present invention, where a rate of adsorption of the antifoggant to the surface of silver halide grains, such a problem can be eliminated by an embodiment in which the gelatin content of the system during the stage until the antifoggant is adsorbed on the silver halide grains is suppressed as low as possible, and the rest of gelatin is added after an adsorption equilibrium is reached. In this embodiment, the amount of gelatin added later is preferably 10% or more, more preferably from 20 to 80%, and most preferably from 40 to 80%, based on the total gelatin content to be coated.

The light sensitive material according to the present invention essentially contains the antifoggant according to the first embodiment and/or the antifoggant according to the second embodiment and may further contain conventionally known antifoggants in combination. Note that the effects of the present invention would be lessened as the proportion of the conventional antifoggants increases. Accordingly, the proportion of the conventional antifoggants in the total antifoggant is preferably not more than 60% by weight, more preferably not more than 30% by weight, and most preferably not more than 20% by weight.

In the light-sensitive material of the present invention, the hydrophilic dispersion media in emulsion layers and light-insensitive layers are preferably in a hardened state. Hardening can be effected with one or more of hardening agents. Examples of usable hardening agents include chromium salts (e.g., chromium alum, chromium acetate), aldehydes (e.g., formaldehyde, glyoxal, glutaraldehyde), N-methylol compounds (e.g., dimethylolurea, methyloldimethylhydantoin), dioxane derivatives (e.g., 2,3-dihydroxydioxane), active vinyl compounds (e.g., 1,3,5-triacryloyl-hexahydro-s-triazine, bis(vinylsulfonyl)methyl ether, N,N'-methylenebis[β-(vinylsulfonyl)propionamide]), active halogen compounds (e.g., 2,4-dichloro-6-hydroxy-s-triazine), mucohalogenic acids (e.g., mucochloric acid, mucophenoxychloric acid), isoxazoles, dialdehyde starch, and 2-chloro-6-hydroxytriazinylated gelatin. These hardening agents may be used alone or in combination. Inter alia, the active vinyl compounds described in JP-A-53-41221, JP-A-53-57257, JP-A-59-162546, and JP-A-60-80846 and the active halogen compounds described in U.S. Pat. No. 3,325,287 are preferred.

High polymeric hardening agents are also effectively used in the present invention.

Examples of usable high polymeric hardening agents include polymers containing an aldehyde group, e.g., dialdehyde starch, polyacrolein, and acrolein copolymers as described in U.S. Pat. No. 3,396,029; polymers containing an epoxy group as described in U.S. Pat. No. 3,623,878; polymers containing a dichlorotriazine group as described in U.S. Pat. No. 3,362,827 and *Research Disclosure*, No. 17333 (1978); polymers containing an active ester group as described in JP-A-56-66841; polymers containing an active vinyl compound or a precursor group thereof as described in JP-A-56-142524, U.S. Pat. No. 4,161,407, JP-A-54-65033, and *Research Disclosure*, No. 16725 (1978). Among them preferred are polymers containing an active vinyl group or a precursor group thereof. In particular, polymers in which an active vinyl group or a precursor group thereof is bonded to the polymer main chain via a long spacer as described in JP-A-56-142524 are preferred. Such polymers preferably include those represented by formula (VI):

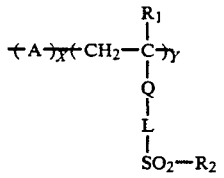

(VI)

wherein A represents a monomer unit with which a copolymerizable ethylenically unsaturated monomer is copolymerized; $R_1$ represents a hydrogen atom or a lower alkyl group having from 1 to 6 carbon atoms (e.g., methyl, ethyl, butyl, n-hexyl), and preferably a hydrogen atom or a methyl group; Q represents $—CO_2—$, $—CON(R_1)—$ (hwerein $R_1$ is as defined above), or an arylene group having from 6 to 10 carbon atoms; L represents a divalent, linking group containing at least one of $—CO_2—$ and

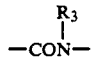

(wherein $R_3$ is a lower alkyl group or an aryl group) and having from 3 to 15 carbon atoms, or a divalent linking group containing at least one of —O—,

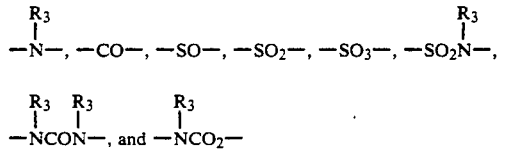

(wherein $R_3$ is as defined above) and having from 1 to 12 carbon atoms; $R_2$ represents a vinyl group or a precursor group thereof selected from $—CH{=}CH_2$ and $—CH_2CH_2X$, wherein X represents a group capable of being substituted by a nucleophilic group or a group releasable in the form of HX by the action of a base; and x and y each represents a mol percent, x being from 0 to 99, preferably from 0 to 75, and y being from 1 to 100, preferably from 25 to 100.

In formula (VI), examples of the ethylenically unsaturated monomer include styrene, hydroxymethylstyrene, sodium vinylbenzenesulfonate, N,N,N-trimethyl-N-vinylbenzylammonium chloride, α-methylstyrene, 4-vinylpyridine, N-vinylpyrrolidone, fatty acid monoethylenically unsaturated esters (e.g., vinyl acetate), ethylenically unsaturated monocarboxylic acids or dicarboxylic acids or salts thereof (e.g., acrylic acid, methacrylic acid), maleic anhydride, ethylenically unsaturated monocarboxylic or dicarboxylic acid esters (e.g., n-butyl acrylate, N,N-diethylaminoethyl methacrylate, N,N-diethyl-N-methyl-N-methacryloyloxyethylammonium p-toluenesulfonate), and ethylenically unsaturated monocarboxylic or dicarboxylic acid amides (e.g., acrylamide, sodium 2-acrylamido-2-methylpropanesulfonate, N,N-dimethyl-N'-methacryloylpropanediaminecacetate betaine).

The linking group Q preferably includes $—CO_2—$, —CONH—,

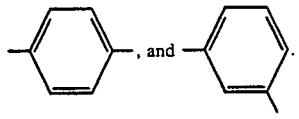

Examples of the linking group L include $—CH_2CO_2CH_2CH_2—$, $—CH_2NHCOCH_2—$, $—(CH_2)_{10}—NHCOCH_2CH_2—$, $—CH_2COCH_2CH_2—$,

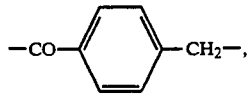

$—SO_2CH_2CH_2SO_2CH_2CH_2—$, $—SO_2NHCH_2CH_2CO_2CH_2CH_2—$, and $—NHCONHCH_2CH_2—$.

Examples of preferred vinyl groups or vinyl precursor groups $R_2$ are $—CH{=}CH_2$, $—CH_2CH_2Br$, $—CH_2CH_2Cl$, and

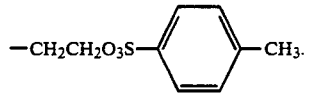

The hydrophilic colloidal layers in the light-sensitive material of the invention are preferably hardened by the above-mentioned hardening agents so as to have a degree of swell in water of not more than 400% (corresponding to 5 times the original thickness), more preferably from 80 to 350%, and most preferably from 80 to 250%.

Silver halide emulsion grains which can be used in the present invention are not particularly limited in halogen composition, grain shape, grain size, and grain structure, and any kind of silver halide grains may be employed. For example, usable halogen compositions include AgCl, AgBr, AgBrI, and mixed crystals thereof within a range of a solid solution limit. With respect to the silver halide grains, descriptions of the literatures hereinafter listed can be referred to.

Additives which can be added at every stages of from grain formation through coating ar not particularly limited. Examples of useful additives include silver halide solvents (also called ripening accelerators), dopants for silver halide grains (e.g., compounds of the group VIII noble metals and other metals, e.g., Au, Fe, Pd, and Cd, chalcogen compounds, SCN compounds), dispersion media, antifoggants, stabilizers, sensitizing dyes (e.g., blue-, green-, red-, infrared-sensitizing dyes, panchromatic sensitizing dyes, orthochromatic sensitizing dyes), supersensitizers, chemical sensitizers (compounds of S, Se, Te, Au, and the group VIII noble metals), and phosphorus compounds used either alone or in combinations thereof; most preferably a combination of a gold compound, a sulfur compound, and a selenium compound or a reducing compound, e.g., stannous chloride, thiourea dioxide, a polyamine, and an amine-borane compound), fogging agents (organic fogging agents, e.g., hydrazine compounds, or inorganic fogging agents), surface active agents (e.g., defoaming agents), emulsion flocculants, soluble silver salts (e.g., AgSCN, silver phosphate, silver acetate), latent image stabilizers, pressure desensitization preventive agents, thickeners, hardening agents, developing agents (e.g., hydroquinone compounds), and development modifiers. With respect to specific examples of these additives and the usage thereof, the literatures hereinafter listed can be referred to.

The silver halide emulsions of the present invention can be applied not only to B/W light-sensitive materials but color light-sensitive materials. Reference can be made to the literatures hereinafter listed with respect to the details of color development methods, layer structures, use of color filters, usable dye image forming materials, color image forming materials or non-color image forming materials capable of releasing a photographically useful fragment such as a development inhibitor and a development accelerator upon color development (e.g., DIR couplers, super DIR couplers, DAR couplers, DTR compounds), DIR compounds which are oxidatively split off, polymer couplers, couplers capable of producing weakly diffusible dyes, colored dye-forming couplers for color masking and/or competing couplers, scavengers, bleaching of developed silver or omission of bleaching, dye image stabilizers, omission of a yellow filter layer, and so on.

Any of known techniques and known compounds described in the following literatures can be applied to the silver halide emulsions either individually or in any combination thereof.

*Research Disclosure,* Vol. 176, Item 17643 (Dec., 1978), ibid., Vol. 184, Item 18431 (Aug., 1979), ibid., Vol. 217, Item 21728 (May, 1982), ibid., Vol. 307, Item 307105 (Nov., 1989), E. J. Birr, *Stabilization of Photographic Silver Halide Emulsions,* Focal Press, London (1974), T. H. James (ed.), *The Theory of Photographic Process,* 4th Ed., Macmillan, New York (1977), P. Glafkides, *Chimie et Physique Photographiques,* 5th Ed., Part 3, Edition de l'Usine Nouvelle, (1987), ibid., 2nd Ed., Poul Montel, Paris (1957), V. L. Zelikman, et al., *Making and Coating Photographic Emulsion,* Focal Press (1964), K. R. Hollister, *Journal of Imaging Science,* Vol. 31, pp. 148–156 (1987), J. E. Maskasky, *Journal of Imaging Science,* Vol. 30, pp. 247–254 (1986), ibid., Vol. 32, pp. 160–177 (1988), Frieser, et al., *Die Grundlagen Der Photographischen Prozesse Mit Silverhalogeniden,* Akademische Verlaggesellschaft, Frankfurt (1968), *Nikkakyo Geppo,* Issue of Dec., 1984, pp. 18–27, *Nihon Shashin Gakkaishi,* Vol. 49, pp. 7–12 (1986), ibid., Vol. 52, pp. 144–166 (1989), JP-A-58-113926 to 113928, JP-A-59-90841, JP-A-58-111936, JP-A-62-99751, JP-A-60-143331, JP-A-60-143332, JP-A-61-14630, JP-A 62-6251, JP-A-63-220238, JP-A-63 151618, JP-A-63-281149, JP-A-59-133542, JP-A-59-45438, JP-A-62-269958, JP-A 63-305343, JP-A-59-142539, JP-A-62-253159. JP-A-63-220238, JP-A-62 266538, JP-A-63-78465, JP-A-1-158429, JP-A-1-131541, JP-A-2-838, JP-A-2-34, JP-A-2-146033, JP-A-2-28638, JP-A-1-27449, JP-A-1-183417, JP-A-2-127635, and U.S. Pat. Nos. 4,636,461, 4,707,436, 3,761,276, and 4,269,927.

With respect to gelatin, reactive groups, and hardening agents, reference can be made particularly to A. G. Ward and A. Courts (ed.), *The Science and Technology of Gelatin,* Academic Press, New York (1977).

The silver halide photographic materials according to the present invention are useful as B/W silver halide photographic materials including X ray films, light-sensitive materials for printing, photographic paper, negative films, microfilms, direct positive films, and ultrafine-grain dry plates (for LSI photomasks, shadows, liquid crystal masks) and color photographic materials including negative films, photographic paper, reversal films, direct positive color films, and silver dye bleach process photography. They are also useful as light-sensitive materials for diffusion transfer process (e.g., color diffusion transfer elements, silver salt diffusion transfer elements), heat-developable B/W or color light-sensitive materials, high-density digital recording materials, and holographic light-sensitive materials.

The present invention is now illustrated in greater detail by way of the following Examples, but it should be understood that the present invention is not deemed to be limited thereto. All the percents, parts, and ratios are by weight unless otherwise indicated.

EXAMPLE 1

An octahedral AgBr grain emulsion (mean grain size: 0.7 μm) was prepared according to the controlled double jet method described in JP-A-2 146033 and adjusted to a pH of 6.4, a pBr of 26, and a concentration of 0.7 mol/l. The emulsion was heated to 55° C., and $Na_2S_2O_3.5H_2O$ was added thereto in an amount of $4\times10^{-5}$ mol per mol of AgBr. Five minutes later, the emulsion was subjected to gold sensitization with $1\times10^{-5}$ mol/mol-AgBr of an $HAuCl_4$/NaSCN mixture for 50 minutes. The temperature was decreased to 40° C., and $5\times10^{-3}$ mol/mol-AgBr of 4-hydroxy-6-methyl-1,3,3a,7-tetraazaindene (hereinafter abbreviated as TAI) was added to the emulsion and, then, sodium dodecylbenzenesulfonate as a coating aid, sodium poly(4-sulfostyrene) as a thickener, and 1.4 ml/10 g gelatin of a 4% solution of a hardening agent shown below were added thereto.

Hardening Agent:

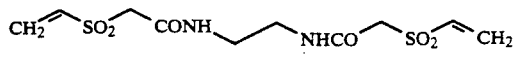

The resulting coating composition was coated on a transparent cellulose triacetate film to a silver coverage of 1.5 g/m$^2$ simultaneously with a gelatin protective layer. After drying, the coated film was rolled, heated in a sealed can at 40° C. for 15 hours to allow a hardening reaction to proceed, and taken out. The resulting sample was designated Sample 101.

Sample 102 was prepared in the same manner as for Sample 101, except for replacing the antifoggant, TAI, with $1.9\times10^{-3}$ mol/mol-AgBr of Compound A prepared in Synthesis Example 1.

Each of Samples 101 and 102 was uniformly exposed to white light under the same conditions and separately developed with a developer "HiRendol" produced by Fuji Photo Film Co., Ltd. at 20° C. for 4 minutes. Each of the used developers was subjected to liquid chromatography to separate the eluted antifoggant, and the amount of the eluted antifoggant was determined by spectroscopic analysis. The amount of the antifoggant eluted from Sample 101 being taken as 100, that from Sample 102 was found to be 10 or less, proving that elution of the antifoggant into a developing solution was significantly prevented.

Samples 101 and 102 both had a fog density of 0.07, showing equality in antifogging effect. Further, each sample was immersed in an aqueous solution at pH 10.0 and 40° C. for 20 minutes to conduct an elution test previously described. As a result, the y value of Samples 101 and 102 was found to be 0% and 85%, respectively.

Samples 103 and 104 were prepared in the same manner as for Sample 101, except for replacing TAI with Compound B or Compound C, respectively, and tested in the same manner as described above. The results obtained are shown in Table 1 below.

TABLE 1

| Sample No. | Antifoggant | Fog Density | y Value (%) | Remark |
|---|---|---|---|---|
| 101 | TAI | 0.07 | 0 | Comparison |
| 102 | Compound A | 0.07 | 85 | Invention |
| 103 | Compound B | 0.07 | 90 | " |
| 104 | Compound C | 0.07 | 88 | " |

EXAMPLE 2

Samples 201 to 203 were prepared in the same manner as for Sample 101 of Example 1, except for replacing TAI with $1.9\times10^{-3}$ mol/mol-AgBr of Compound D, E, or F shown below.

Compound D, E, or F was prepared by adding Compound A, B, or C, respectively, to a 30% aqueous solution of low-molecular gelatin having an average molecular weight of 20,000 at a compound to gelatin molar ratio of 1:10, and the mixture was uniformly mixed, dried, and heated in a sealed container at 60° C. for 15 hours. The low-molecular gelatin used here was alkali-processed ossein gelatin (deionized) in which 90% or more of arginine had been converted to ornithine.

Compound D:

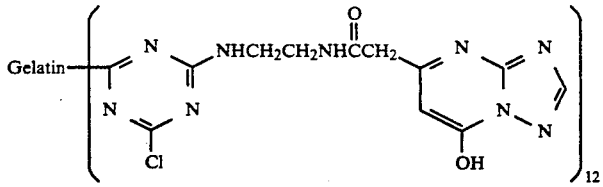

Compound E:

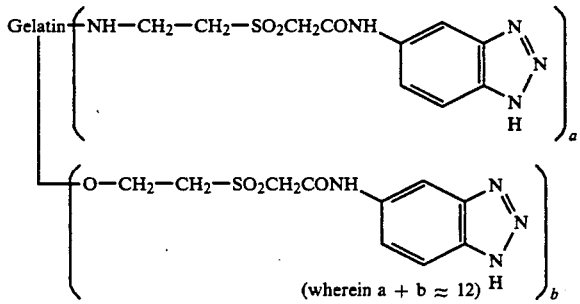

The above structure of Compound E comes from bonding reactions of Compound B not only to the amino group but also to the hydroxyl group of gelatin.

Compound F:

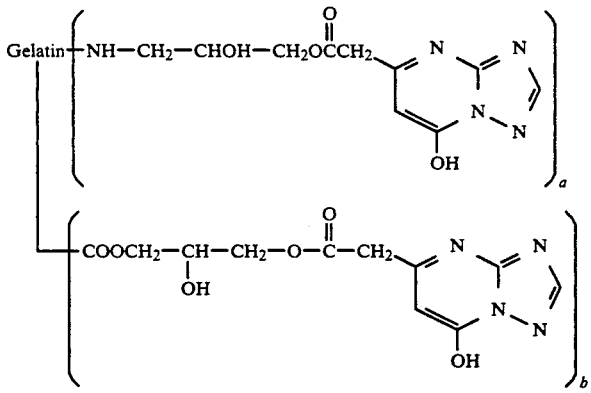

The above structure of Compound F comes from bonding reactions of Compound C not only to the amino group but also to the hydroxyl group of gelatin.

Each of Samples 201 to 203 was evaluated in the same manner as in Example 1. The results obtained are shown in Table 2 below.

TABLE 2

| Sample No. | Antifoggant | Fog Density | y Value (%) | Bonding Ratio (wt %) |
|---|---|---|---|---|
| 201 | Compound D | 0.07 | 90 | 8.4 |
| 202 | Compound E | 0.07 | 95 | 8.0 |
| 203 | Compound F | 0.07 | 96 | 8.4 |

EXAMPLE 3

Sample 301 was prepared in the same manner as for Sample 101, except for replacing TAI with $10^{-3}$ mol/mol-AgBr of 1-phenyl-5-mercaptotetrazole.

Sample 302 was prepared in the same manner as for Sample 101, except for replacing TAI with $3.4\times10^{-4}$ mol/mol-AgBr of Compound G shown below.

Compound G:

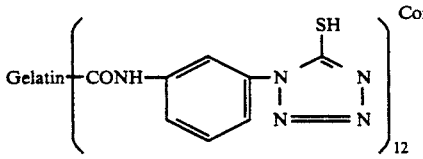

Compound G is a compound prepared by bonding an antifoggant to the carboxyl group of the same low-molecular gelatin as used in Example 2 through an amido linkage. The number of the antifoggant molecules bonded per molecule of gelatin was 12 in average (bonding ratio: 10%).

Samples 301 and 302 were evaluated in the same manner as in Example 1 and, as a result, found to have a y value of 0% and 92%, respectively, while both having a fog density of 0.06, thus confirming the effects of the present invention.

EXAMPLE 4

Sample 401 was prepared by adding $5\times10^{-3}$ mol/mol-AgBr of Compound (IV-5) to the same chemically sensitized AgBr emulsion as used in Sample 101 and, after an adsorption equilibrium was reached, the emulsion was treated in the same manner as for Sample 101.

Sample 402 was prepared by adding Compound H shown below to the same chemically sensitized AgBr emulsion as used in Sample 101 in an effective amount of $5\times10^{-3}$ mol/mol-AgBr, and the emulsion was treated in the same manner as for Sample 101.

Compound H:

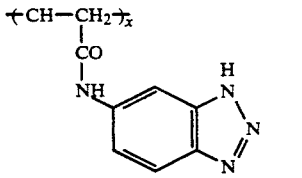

(wherein x ≈ 50)

Sample 403 was prepared in the same manner as for Sample 202, except for replacing the low-molecular gelatin in Compound E with a conventionally known gelatin species having an average molecular weight of about 100,000 and changing the number of antifoggant molecules bonded per molecule of gelatin to 9 (bonding ratio: about 1.3%), and adding the antifoggant in an amount of $1.9\times10^{-3}$ mol/mol-AgBr.

Sample 404 was prepared in the same manner as for Sample 403, except for changing the number of bonded antifoggant molecules was increased to 45 (bonding ratio: about 6.5%) and adding the antifoggant in an amount of $1.9\times10^{-3}$ mol/mol AgBr.

Each of Samples 401 to 404 was evaluated in the same manner as in Example 1. The results obtained are shown in Table 3 below.

TABLE 3

| Sample No. | Antifoggant | Fog Density | y Value (%) | Remark |
|---|---|---|---|---|
| 401 | Compound IV-5 | 0.07 | 86 | Invention |
| 402 | Compound H | 0.13 | 60 | Comparison |
| 403 | — | 0.13 | 97 | " |
| 404 | — | 0.09 | 97 | Invention |

Compound H used in Sample 402 had a deteriorated antifogging function due to its poor compatibility with gelatin. The results of Sample 403 reveal that an increase in molecular weight of the gelatin moiety renders the bonded antifoggant non-diffusible and reduces the antifogging function. It can be seen from the results of Sample 404 that even if the gelatin moiety has a high molecular weight, the antifogging function can be improved by increasing the bonding ratio of the antifoggant moiety.

According to the present invention, elution of an antifoggant from a light-sensitive material under development processing into a developing solution can be surely prevented thereby to increase developing capacity of a developing solution and to reduce a scatter in developing performance.

In the present invention, an antifoggant is immobilized by a dispersion medium after it is adsorbed onto the surface of silver halide grains. This means that immobilization is independent of adsorption. Thus, the conflict between non-diffusion of an antifoggant and adsorptivity of the antifoggant which has been encountered with conventional antifoggants can be eliminated by the present invention.

Further, nitrogen-containing heterocyclic antifoggant compounds such as 2-mercaptobenzothiazole, 2-(4-thiazolyl)benzimidazole, and 2-methoxycarbonylaminobenzimidazole also possess an antiseptic effect on a hydrophilic dispersion medium (reference can be made to JP-A-59-228247). These compounds remaining in a light-sensitive material after development processing serves as an antiseptic making it feasible to preserve the processed light-sensitive material for an extended period of time.

In the conventional techniques of adding to a gelatin dispersion medium a high-molecular antifoggant different from gelatin, poor compatibility of the antifoggant with gelatin has given rise to a problem of haze due to phase separation. To the contrary, where gelatin serving as a dispersion medium is also used as a high polymer for immobilizing an antifoggant according to the present invention, such a problem does not arise.

In case of using gelatin as a dispersion medium, the sites at which antifoggant molecules are bonded are at some intervals so that the antifoggant is effectively absorbed and, hence, no hinderance is imposed on adsorption.

While the invention has been described in detail and with reference to specific examples thereof, it will be apparent to one skilled in the art that various changes and modifications can be made therein without departing from the spirit and scope thereof.

What is claimed is:

1. A silver halide light-sensitive material containing at least silver halide grains, a gelatin dispersion medium, a pendant-2 type antifoggant, and a hardening agent, wherein said pendant-2 type antifoggant is an antifoggant covalently bonded to a low-molecular weight gelatin dispersion medium.

2. A silver halide light-sensitive material as in claim 1, wherein said pendant-2 type antifoggant is represented by formula (I-2):

$$(\text{Antifoggant}-\text{L})_m(\text{Low-Molecular Gelatin}) \quad \text{(I-2)}$$

wherein L represents a divalent linking group; and m represents a number of antifoggant molecules bonded per molecule of gelatin.

* * * * *